United States Patent [19]

Ludwig

[11] 4,199,671

[45] Apr. 22, 1980

[54] PUFFER CIRCUIT BREAKER

[75] Inventor: Howard C. Ludwig, Forest Hills Boro, Pa.

[73] Assignee: Westinghouse Electric Corp., Pittsburgh, Pa.

[21] Appl. No.: 873,330

[22] Filed: Jan. 30, 1978

[51] Int. Cl.[2] ..... H01H 33/88

[52] U.S. Cl. ..... 200/144 R; 200/148 A; 200/148 F

[58] Field of Search ..... 200/148 R, 148 A, 148 B, 200/148 C, 148 D, 148 E, 148 F, 148 G, 148 H, 148 J, 148 BV, 150 G, 144 R

[56] References Cited

U.S. PATENT DOCUMENTS

| | | | |
|---|---|---|---|
| 3,659,065 | 4/1972 | Roidt et al. | 200/148 R |
| 3,852,551 | 12/1974 | Cleaveland | 200/148 A |
| 3,991,292 | 11/1976 | Perkins | 200/148 A |

FOREIGN PATENT DOCUMENTS

| | | | |
|---|---|---|---|
| 914400 | 1/1963 | United Kingdom | 200/148 B |

*Primary Examiner*—Gene Z. Rubinson
*Assistant Examiner*—Morris Ginsburg
*Attorney, Agent, or Firm*—L. P. Johns

[57] ABSTRACT

A puffer circuit breaker characterized by adjustable wall means for regulating the pressure of an arc-extinguishing gas between separating contacts.

8 Claims, 2 Drawing Figures

PUFFER CIRCUIT BREAKER

BACKGROUND OF THE INVENTION

1. Field of the Invention

This invention relates to circuit interrupters and, more particularly, it pertains to AC power circuit breakers in which a gas blast is employed for interrupting performance.

2. Description of the Prior Art

In circuit breakers in which an alternating current arc discharge occurs, the removal of arc energy from a critical zone must keep pace with formation of arc energy so that as the current falls to zero, the remaining arced gas is innocuous to arc reignition. In the post-current-zero period, the critical zone must have a dielectric strength sufficient to prevent breakdown under the condition of a rapidly rising voltage which is a function of the fault condition and circuit.

Experimental findings have led to further clarifying criteria particularly related to the use of relatively low temperature dissociating arc gas media and specifically to the use of sulfur hexafluoride in the class of puffer circuit breakers. In that class piston action is provided, occurring within the pressurized cavity of the breaker so that when the interruption operation is executed, cold gas flows through a nozzle, conditioned by the formed positive pressure gradient along the nozzle's longitudinal axis. The dissociation of the arced-sulfur-hexafluoride gas ($SF_6$) contributes significantly to the increase of this pressure gradient and ultimately develops a higher gas velocity by known laws of physical chemistry and fluid dynamics. However, when the average enthalpy (kilojoules/gm) of the arced $SF_6$ exceeds that value corresponding to an average temperature exceeding the fully dissociated gas level, the contribution of the thermalized gas to the development of the pressure gradient is considerably reduced.

Another criterion associated with the foregoing has been the necessity for rectifying a rapid decrease of pressure in the confines of the arc chamber in the time of a descending current side of a half cycle of arc current and the oscillatory nature of longitudinal pressure wave set up in the closed cavity of the circuit breaker. This relates to the objective of establishing a high cold gas pressure in the critical-arc-chamber zone in the post-current-zero period. The dielectric strength of the $SF_6$ increases with the cold gas pressure.

SUMMARY OF THE INVENTION

In accordance with a preferred embodiment of this invention, there is provided a puffer interrupter comprising an elongated insulating casing having opposite end walls forming a chamber containing an arc-extinguishing gas, a generally tubularly shaped stationary contact structure within the chamber and extending from one end wall thereof, a movable contact aligned with the stationary contact structure and movable between open and closed positions with the stationary contact structure, a stationary insulating nozzle having a bore within which the movable contact is mounted, the nozzle having an outwardly flared end surface spaced from and facing one end wall, an elongated cylinder within the chamber and around the said contact structure and the nozzle, the nozzle being in fluid-tight contact with the cylinder, the cylinder portion surrounding said contact structure having an inturned annular portion in fluid-tight contact with said contact structure, the cylinder and said contact structure forming an annular compartment for containing the arc-extinguishing fluid and extending from said annular portion to said flared end surface, the cylinder being movable between positions relatively near and away from the first end wall corresponding respectively to the closed and opened portions of the contacts, means for moving the movable contact and the cylinder between said positions to effect a flow of gas-extinguishing fluid at an arc incurred when the contacts are open, and tuning wall means within said contact structure for regulating the expansion of the fluid at the arc to a ratio of the downstream pressure to the upstream pressure at about 0.59.

The advantage of the device of this invention is that a puffer circuit breaker is provided with a rectification of the gas pressure change and an optimization of through-put gas flow within the time of the arc circuit interrupter so that the average enthalpy level of the through-put $SF_6$ gas (arc-extinguishing fluid) does not significantly exceed the average temperature corresponding to the 100% dissociation of the gas for which the circuit breaker is subjected.

One objective of this invention is to overcome mass flow limitations with provision for achieving control of the average gas enthalpy within the requirement of the circuit breaker.

DESCRIPTION OF THE PREFERRED EMBODIMENT

Figure 1:
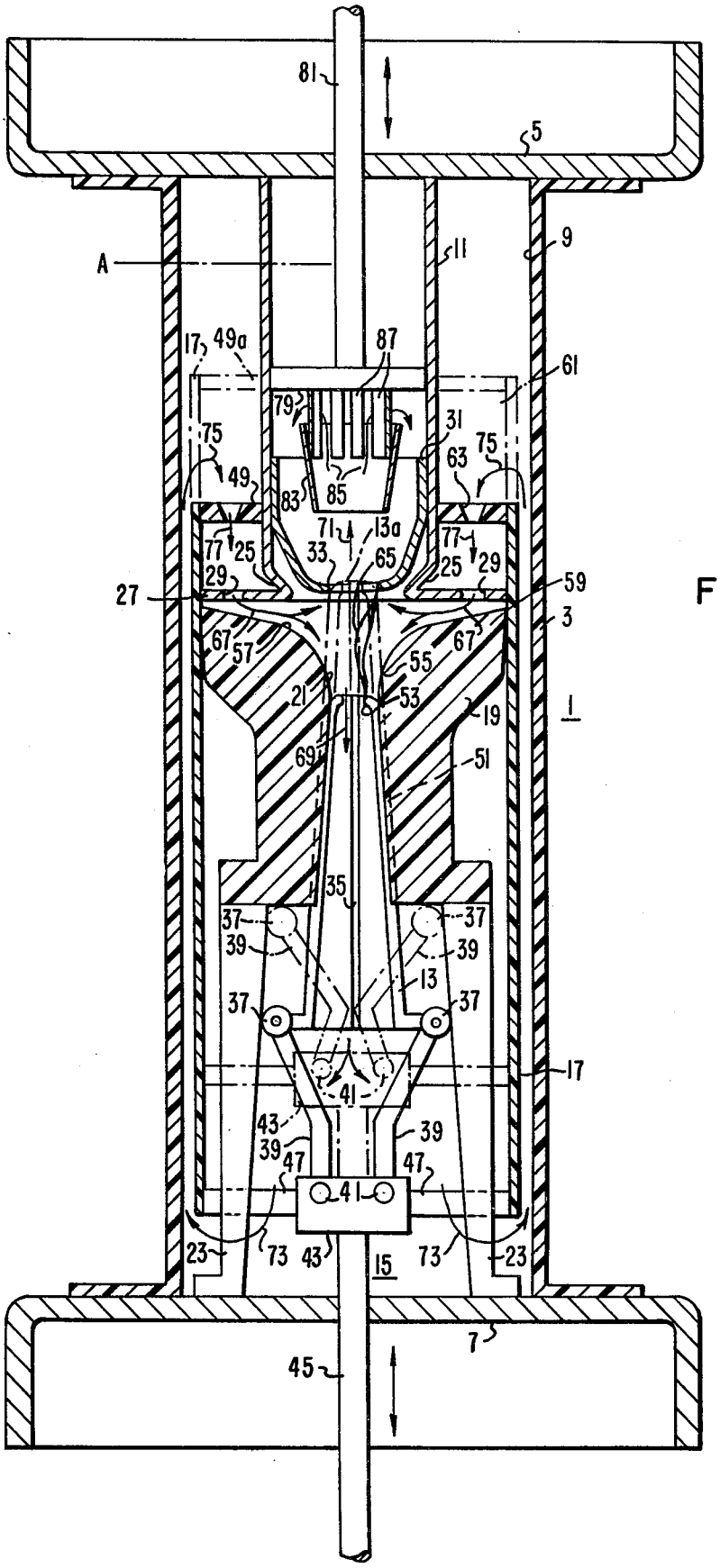
FIG. 1 is a vertical sectional view through a typical buffer type circuit interrupter.

In FIG. 1 a circuit interrupter of the puffer type is generally indicated at 1 and it comprises an elongated casing 3 extending between opposite end walls 5 and 7 and forming a chamber 9. The chamber 9 contains an arc-extinguishing fluid, such as sulfur-hexaflouride gas ($SF_6$) at a preferred pressure of 5 atm. psia. Generally, the circuit interrupter of this invention has structure and operation resembling those shown in U.S. Pat. Nos. 3,659,065, 3,852,551 and 3,991,292.

A generally tubularly shaped stationary contact structure 11 is disposed at one end of the chamber 9 and a movable contact 13 is disposed in alignment therewith. Means 15 for moving the movable contact 13 between open and closed positions are provided at the lower portion of the chamber 9. Moreover, an operating cylinder 17 is provided for compressing the arc-extinguishing fluid for extinguishing an arc when the contacts are separated.

The casing 3 is comprised of an electrically insulating material and opposite ends are fixedly attached to the end walls 5, 7 in a fluid-tight manner for retaining the arc-extinguishing fluid within the chamber 9. The operating cylinder 17 is likewise composed of an electrically insulating material and is operated in a manner set forth hereinbelow. Within the operating cylinder 17 an annular nozzle 19 having a central bore 21 is mounted on a plurality of spaced support members 23, the lower ends of which are mounted on the end wall 7.

An electric circuit through the circuit interrupter 1 extends from the end wall 5 and through the contact structure 11, the movable contact 13, and the moving means 15 to the end wall 7.

The stationary contact structure 11 is a tubular member attached to and extending from the end wall 5. The lower end portion of the contact structure 11 is preferably turned inwardly at 25 and is provided with an outturned annular flange 27 the outer periphery of which is in contact with the inner surface of the cylinder 17. Spaced apertures 29 around the flange 27 provide communication with chamber areas on opposite sides of the flange.

Within the tubular contact structure 11 a cup-shaped contact 31 is located and is provided with an aperture 33 in which the upper end portion of the movable contact 13 is disposed when in the closed position at 13*a*.

The movable electrode 13 is comprised of a plurality, peripherably three, vertical sections separated by longitudinal spaces such as a space 35. Each vertical section of the electrode 13 is pivotally mounted at its lower end on contact rollers 37 which in turn are rotatably mounted on spaced support links 39. The lower end of each link 39 is pivotally mounted at 41 on a platen 43 which in turn is disposed at the upper end of an operating rod 45. Thus the moving means 15 comprises the rod 45, the platen 43, the pivots 41, the links 39, and the pivot rollers 37.

The moving means 15 also comprises a plurality of radially-spaced arms 47 extending from the platen 43 to the lower end of the operating cylinder 17 in support thereof. At its upper end the operating cylinder 17 includes an in-turned flange 49 which is in slidable and fluid-tight contact with the outer surface of the tubular contact structure 11. The several sections of the movable contact 13 are slidable along the bore 21 of the nozzle 19. For that purpose the bore is provided with spaced-guide grooves 51, in which the several sections are located for vertical movement between the open and closed positions of the contact. Moreover, the upper end portion 53 of each vertical section of the movable contact 13 is turned inwardly to facilitate insertion into the aperture 33 of the contact 31. In addition, the bore 21 of the nozzle 19 has a configuration of a throat or venturi tube in that the bore has a minimum cross section at 55 below which the bore wall diverges downwardly. Above the minimum cross-section zone 55 the nozzle 19 comprises an outwardly flared end surface 57 which diverges from the minimum cross-section zone 55 to the nozzle periphery at 59 where the nozzle is in sliding and fluid-tight contact with the inner surface of the operating cylinder 17.

In operation, when the contacts 13, 31 are in the closed position as indicated by the position of the movable contact 13, that cylinder 17 is in the elevated position 49*a*. In that position an annular compartment 61 is disposed between the contact structure 13 and the cylinder 17 as well as between the end wall 49 and the flange 27. Due to the provision of the several apertures 29 in the flange 27 as well as restrictive apertures for one way valves 63 in the flange 49, $SF_6$ gas enters the compartment 61 from the surrounding chamber 9 until the gas pressures within the circuit breaker are equalized.

When the operating rod 45 is lowered in response to an occurrence such as a short circuit, the movable contact 13 moves to the open or solid line position of FIG. 1 and an arc 65 occurs between the separating contacts. As the cylinder 17 is lowered to the solid line position the compartment 61 is reduced by the downcoming flange 49 whereby $SF_6$ gas is suppressed and directed downwardly through the apertures 29 against the outwardly flared end surface 57 and into the zone of the arc 65 as indicated by the several arrows 67. Some of the gas is directed downwardly via arrow 69 through the bore 21 while other gas is directed upwardly via arrow 71. The pressure of the gas when compressed in the compartment 61 is sufficient to extinguish the arc 65 in the required time period. Meanwhile, arrows 73, 75, and 77 indicate the path of travel of the gas from the zone of the arc; that is, the gas moves to areas of lower pressure.

Figure 2:
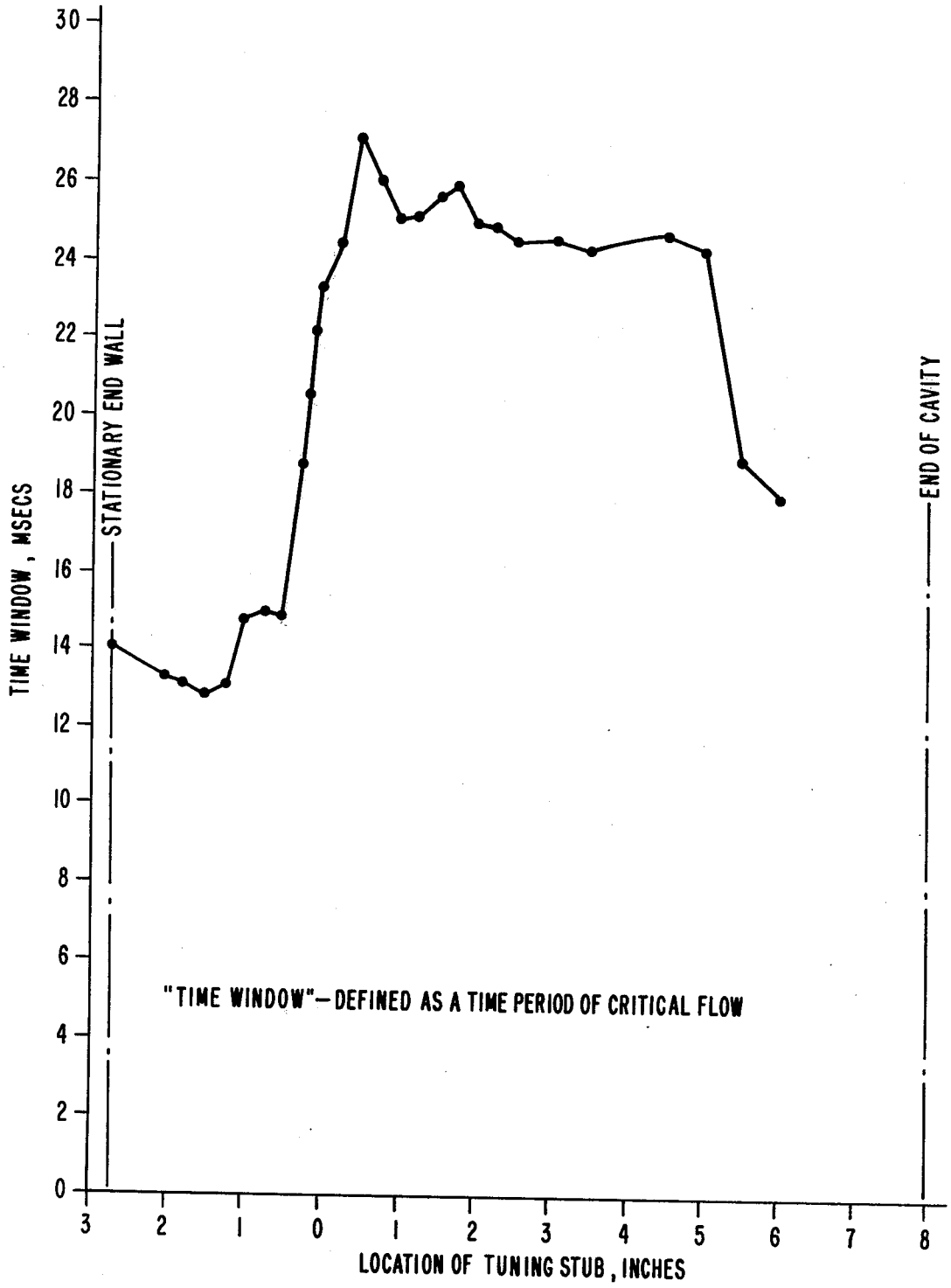
FIG. 2 is a graph showing the time-location profile of gas flow within the arc chamber.

In accordance with this invention it has been found that the motion of the gas and arc establish pressure waves along the longitudinal axis of the breaker cavity with the peak of the pressure in the arc zone being 180° out of phase with the end wall. In FIG. 2 time-distance data, which were obtained by experimentation, as a function of fault current at the arc zone are plotted to show the incidents of gas flow within the arc chamber. It shows a "time window" which is indicated by an increase of from about 14 to 26 milliseconds. In the interruption of the A.C. circuit a period of time in which it is desirable to execute this action in reference to the time of ½ cycle of the 60 hertz and to the mechanical action times associated with the interrupter's components such as the piston action time, and parting of contacts. In 60 hertz circuits with 0.008+ seconds per ½ cycle, one needs a time window of about 3× the period of a half cycle for random opening time of the contacts with reference to the 60 hertz signal. As shown in the graph of FIG. 2 a "time window" of 0.026 seconds is provided which is ample for the 60 hertz usage. On the descending current side of a current half cycle, the pressure in the arc zone falls rapidly due to the expulsion of gas through the nozzle and due to the contraction and densification of the cooling arc plasma as the current falls to zero in the loop of the circuit interruption. The low pressure that can occur in this region during the recovery period of the circuit is undesirable and can lead to a restrike of the arc with a continuing flow of fault current.

$SF_6$ gas is a heavy gas with a velocity of sound less than about 131 meters per second or about one third the rate of air. Sound is important because of the pressure waves in the gas which should influence the design of the circuit breaker. In an AC circuit breaker it is desirable to interrupt the arc circuit within a one half cycle of 60 hertz. Thus it is desirable to provide the highest pressure of $SF_6$ gas at the peak of the current cycle. For this purpose tuning wall means or surface 79 is provided within the contact structure 11 for convenience of adjusting the position of the surface 79 with respect to its distance from the arc zone. The tuning wall means or surface may be provided as a piston mounted on a piston rod 81, whereby upon testing, rectification of the several pressures within the chamber 9 is readily achieved. Accordingly, when rectification is obtained the position of the tuning wall means or surface 79 may be set by suitable set means such as a set screw on the piston rod 81. A suitable setting for the tuning wall means or surface 79 occurs when the gas flows with the velocity of sound at the throat (cross-section 55) of the nozzle. Another means for establishing the position of the surface 79 is to establish a critical pressure ratio of about 0.59 which is the ratio of the downstream pressure to the upstream pressure, the downstream pressure being the pressure of the gas between the throat or cross-section 55, and the end wall 7 and the upstream pressure being the pressure between the throat and the surface 79.

When the opening operation is initiated the cylinder 17 and the movable contact 13 move downward. The explosive force of the arc initiation causes the gas to flow through the nozzle and to back up into the contact structure 11. The pressure in the contact structure and the arc zone continue to rise until the current starts to decrease on the decreasing side of the half cycle. As this occurs the pressure starts to drop rapidly. During the pressure rise period however, a pressure wave propagates to the surface 79. The time of the peak pressure occurring in the contact structure 11 depends on the location of the surface 79. Its correct position should be such as to provide for rapid rectification of the decreasing pressure developed in the arced zone as the current decreases to zero in the interrupting half cycle period.

The proximity of the contact structure 11 reduces the rectification time thus preventing the pressure in the arc chamber from reaching a low value. The effectiveness of the contact structure 11 is explained by causing the flow of gas to penetrate to the end wall faster causing a vortex ring to develop so that the hot gas flowing inward can mix with the cold gas exiting there initially. As a positive pressure gradient is developed between the surface 79 and the arc zone, gas flows into the arc zone to rectify the growing low pressure condition. All gas is then directed downstream through the nozzle.

For example, for a peak fault current of 50 kamps. amounting to about 300 kilojoules of arc energy in two half cycles of 60 hertz circuit time, about 18 gms of $SF_6$ are required to keep the average temperature of the arced gas below 4000° K. This temperature corresponds to an enthalpy value just above the complete dissociation temperature of the puffer gas. The piston compressing volume contains 60 gms of gas at 6 atm. In the puffer design herein proposed, the piston can be significantly reduced in size so that the compression volume would only need to contain about 40 gms of $SF_6$ and yet achieve to 50 kiloamp. rating. The higher pressure developed in the post arc period should provide conditions for puffer type circuit breakers.

Another embodiment of the invention includes the provision of a baffle 83 for establishing a smoother flow of gas as indicated by arrows 85. The baffle 83 is preferably an inverted truncated cone which is supported by spaced members 87 on the surface 79. Accordingly, $SF_6$ gas entering the aperture for venturi as indicated by the arrow 71 flows toward the surface 79 and is redirected downwardly as indicated by the arrows 85.

Accordingly, the device of this invention assists in rectifying a certain drop in gas pressure in the critical arc chamber zone as the arc current descends to zero as well as providing for a true unobstructing convergent nozzle electrode which optimizes the axial gas velocity and mass through-put so that the average temperature of the gas is limited to about 4000° K.

What is claimed is:

1. A puffer interrupter comprising an elongated insulating casing having a first end wall and an oppositely disposed second end wall, the casing and the walls forming a chamber containing an arc-extinguishing fluid, a generally tubularly shaped stationary contact structure within the chamber and comprising a conductor tube extending from the first end wall, a movable contact aligned with the stationary contact structure and movable between open and closed positions with the conductor tube, a stationary annular insulating nozzle having a bore within which the movable contact is mounted, the nozzle walls forming the bore comprising a throat of reduced cross-section and having an outwardly flared end surface spaced from and facing the first end wall, an elongated cylinder within the chamber and around said contact structure and the nozzle, the nozzle being in fluid-tight contact with the cylinder, the cylinder surrounding said contact structure having an inturned annular portion in fluid-tight contact with said contact structure, the cylinder and said contact structure forming an annular compartment for containing the arc-extinguishing fluid and extending from said annular portion to said flared end surface, the cylinder being movable between positions relatively near and away from the first end wall corresponding respectively to the closed and open positions of the contact and contact structure, means for moving the contact and the cylinder between said positions to effect a flow of arc-extinguishing fluid at an arc incurred when the contact and contact structure are opened, and tuning wall means within said contact structure for regulating expansion of the fluid at the arc to a ratio of the downstream pressure to the upstream pressure and comprising a piston adjustably mounted within the conductor tube.

2. The puffer interrupter of claim 1 in which the fluid flows at the velocity of sound at the throat of the nozzle.

3. The puffer interrupter of claim 1 in which the fluid flow ratio is about 0.59.

4. The puffer interrupter of claim 1 in which said stationary contact structure comprises an inturned end portion.

5. The puffer interrupter of claim 2 in which means are provided for adjusting the position of the piston relative to the throat of the nozzle.

6. The puffer interrupter of claim 1 in which the movable contact is within the stationary contact structure when the contacts are closed.

7. The puffer interrupter of claim 1 in which fluid baffle means is disposed within the stationary contact structure for directing flow of the fluid therein when the contact and contact structure are opened.

8. The puffer interrupter of claim 7 in which the fluid baffle means is a tubular member mounted on the tuning wall means.

* * * * *